US009050803B2

(12) United States Patent
Koda

(10) Patent No.: US 9,050,803 B2
(45) Date of Patent: Jun. 9, 2015

(54) LIQUID EJECTION HEAD AND IMAGE FORMING APPARATUS INCLUDING THE LIQUID EJECTION HEAD

(71) Applicant: Tomohiko Koda, Kanagawa (JP)

(72) Inventor: Tomohiko Koda, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/932,155

(22) Filed: Jul. 1, 2013

(65) Prior Publication Data

US 2014/0009544 A1 Jan. 9, 2014

(30) Foreign Application Priority Data

Jul. 6, 2012 (JP) ..... 2012-152726

(51) Int. Cl.

| | |
|---|---|
| ***B41J 2/17*** | (2006.01) |
| ***B41J 2/175*** | (2006.01) |
| ***B41J 2/14*** | (2006.01) |
| ***B41J 2/055*** | (2006.01) |
| ***B41J 2/16*** | (2006.01) |

(52) U.S. Cl.

CPC ..... *B41J 2/1433* (2013.01); *B41J 2/175* (2013.01); *B41J 2002/14419* (2013.01); *B41J 2002/14403* (2013.01); *B41J 2/17563* (2013.01); *B41J 2/17513* (2013.01); *B41J 2/055* (2013.01); *B41J 2/14024* (2013.01); *B41J 2/1612* (2013.01); *B41J 2/1623* (2013.01)

(58) Field of Classification Search

CPC ..... B41J 2/1433; B41J 2/055; B41J 2/14024; B41J 2/1612; B41J 2/1623; B41J 2002/14419; B41J 2002/14403; B41J 2002/14411; B41J 2/175; B41J 2/17513; B41J 2/17563

See application file for complete search history.

(56) References Cited

U.S. PATENT DOCUMENTS 6,000,784 A * 12/1999 Takemoto et al. ..... 347/50
6,074,048 A * 6/2000 Hotomi et al. ..... 347/71

(Continued)

FOREIGN PATENT DOCUMENTS

JP 2004-358796 12/2004
JP 2005-125631 5/2005

(Continued)

OTHER PUBLICATIONS

U.S. Appl. No. 13/778,271, filed Feb. 27, 2013.

*Primary Examiner* — Julian Huffman
*Assistant Examiner* — Leonard S Liang
(74) *Attorney, Agent, or Firm* — Cooper & Dunham LLP

(57) ABSTRACT

A liquid ejection head includes nozzles, a channel member, a common liquid chamber member, a damper member, a damper chamber formation member, a first adhesive, and a second adhesive. The channel member includes individual liquid chambers communicated with the nozzles. The common liquid chamber member forms a common liquid chamber to supply liquid to the individual liquid chambers. The damper member has a deformable area forming a portion of a wall of the common liquid chamber. The damper chamber formation member forms a damper chamber disposed opposing the common liquid chamber via the deformable area. The first adhesive is disposed between the damper member and the common liquid chamber member. The second adhesive is disposed between the damper member and the damper chamber formation member. The deformable area of the damper member has a peripheral portion fringed with the first adhesive and the second adhesive.

9 Claims, 7 Drawing Sheets

(56) References Cited

U.S. PATENT DOCUMENTS

| | | | | |
|---|---|---|---|---|
| 7,121,643 | B2 * | 10/2006 | Yamada | 347/20 |
| 7,364,285 | B2 * | 4/2008 | Murad et al. | 347/94 |
| 7,984,982 | B2 * | 7/2011 | Okazawa | 347/94 |
| 8,376,540 | B2 * | 2/2013 | Okazawa | 347/94 |
| 8,425,019 | B2 * | 4/2013 | Iwase | 347/85 |
| 8,449,094 | B2 * | 5/2013 | Okubo | 347/94 |
| 8,662,650 | B2 * | 3/2014 | Ono et al. | 347/94 |
| 2006/0007272 | A1 | 1/2006 | Ogata et al. | |
| 2006/0017766 | A1 * | 1/2006 | Ito | 347/20 |
| 2006/0066678 | A1 * | 3/2006 | Rai et al. | 347/54 |
| 2007/0144001 | A1 * | 6/2007 | Ohashi | 29/890.1 |
| 2009/0231400 | A1 * | 9/2009 | Keshishian et al. | 347/87 |
| 2010/0328400 | A1 | 12/2010 | Koda et al. | |
| 2010/0328409 | A1 | 12/2010 | Matsufuji et al. | |
| 2011/0148986 | A1 * | 6/2011 | Murase | 347/44 |
| 2013/0147887 | A1 * | 6/2013 | Kimura et al. | 347/93 |
| 2013/0176363 | A1 * | 7/2013 | Sasaki | 347/40 |
| 2013/0257993 | A1 * | 10/2013 | Ono et al. | 347/54 |
| 2013/0321530 | A1 * | 12/2013 | Taga et al. | 347/47 |

FOREIGN PATENT DOCUMENTS

| | | |
|---|---|---|
| JP | 2006-198903 | 8/2006 |
| JP | 2009-083243 | 4/2009 |
| JP | 2010-188547 | 9/2010 |

* cited by examiner

LIQUID EJECTION HEAD AND IMAGE FORMING APPARATUS INCLUDING THE LIQUID EJECTION HEAD

CROSS-REFERENCE TO RELATED APPLICATIONS

This patent application is based on and claims priority pursuant to 35 U.S.C. §119 to Japanese Patent Application No, 2012-152726, filed on Jul. 6, 2012, in the Japan Patent Office, the entire disclosure of which is hereby incorporated by reference herein.

BACKGROUND

1. Technical Field

This disclosure relates to a liquid ejection head and an image forming apparatus including the liquid ejection head.

2. Description of the Related Art

Image forming apparatuses are used as printers, facsimile machines, copiers, plotters, or multi-functional devices having, e.g., two or more of the foregoing capabilities. As one type of image forming apparatuses employing a liquid-ejection recording method, for example, inkjet recording apparatuses are known that use a recording head (liquid ejection head or liquid-droplet ejection head) for ejecting droplets of liquid (e.g., ink).

Such a liquid ejection head may have a common liquid chamber and individual liquid chambers communicated with nozzles and eject liquid droplets from the nozzles by increasing internal pressure of the individual liquid chambers (also referred to as pressure chambers). Such increased pressure while ejecting liquid droplets from the nozzles, is transmitted to the common liquid chamber. When such pressure is transmitted back to the individual liquid chambers, the pressure in the individual liquid chambers may fluctuate to unexpected values. As a result, liquid droplets may not be ejected at a desired droplet amount and/or speed, thus causing ejection failure. In particular, when a plurality of individual liquid chambers is simultaneously pressurized to eject liquid droplets, a relatively high pressure may be transmitted from the common liquid chamber to the individual liquid chambers, thus causing ejection failure. Such fluctuations in pressure transmitted to the common liquid chamber may be transmitted to adjacent individual liquid chambers and affect liquid in the individual liquid chambers, thus causing unstable liquid ejection or unintentional leak or ejection of liquid droplets from nozzles. As a result, high-quality image output may be hampered.

Hence, for example, JP-2009-083243-A proposes a liquid ejection head having a common liquid chamber plate and a damper plate. The common liquid chamber plate includes a common liquid chamber hole penetrating through the plate and having an elongated shape along an array direction of the pressure chambers to form a common liquid chamber to lead liquid from a liquid supply source to a plurality of pressure chambers. The damper plate has a damper wall to buffer fluctuations in pressure in the common liquid chamber. The damper wall forms a wall portion in which a face of the damper plate opposite a face opposing the common chamber plate is partially recessed and has a relatively small plate thickness at the common liquid chamber side in such recessed area. In plan view, the damper wall has a contour greater than that of the common liquid chamber hole. A peripheral edge of the damper wall forms a thin plate portion of a smaller thickness than a central portion of the damper wall. In plan view, the common liquid chamber plate and the damper plate are adhered each other with the thin plate portion of the damper plate placed outside the common liquid chamber hole.

Alternatively, JP-2006-198903-A proposes an inkjet head having a flexible plate in which a plurality of nozzles is bored. The flexible plate has a portion serving as a wall of a common ink chamber and an attenuation portion more deformable than other portions. The attenuation portion is formed along and near the periphery of the common ink chamber. The wall includes a damper portion for absorbing pressure waves of ink transmitted from pressure chambers to the common ink chamber.

A thinner damper, as shown in JP-2009-083243-A and JP-2006-198903-A, is more likely to absorb vibration. However, the inventor has recognized that such a thinner damper is more likely to be damaged at a starting portion of deformation. In particular, when initial liquid filling is performed on the inkjet head, liquid is sucked from the recording head or supplied to the recording head by pressurizing the head. As a result, the damper may be excessively deformed, which becomes more likely to be damaged.

BRIEF SUMMARY

In an aspect of this disclosure, there is provided a liquid ejection head including a plurality of nozzles, a channel member, a common liquid chamber member, a damper member, a damper chamber formation member, a first adhesive, and a second adhesive. The plurality of nozzles ejects liquid droplets. The channel member includes a plurality of individual liquid chambers communicated with the plurality of nozzles. The common liquid chamber member forms a common liquid chamber to supply liquid to the plurality of individual liquid chambers. The damper member has a deformable area forming a portion of a wall of the common liquid chamber. The damper chamber formation member forms a damper chamber disposed opposing the common liquid chamber via the deformable area of the damper member. The damper member is disposed between the common liquid chamber member and the damper chamber formation member. The first adhesive is disposed between the damper member and the common liquid chamber member to bond the damper member with the common liquid chamber member. The second adhesive is disposed between the damper member and the damper chamber formation member to bond the damper member with the damper chamber formation member. The deformable area of the damper member has a peripheral portion fringed with the first adhesive and the second adhesive.

In another aspect of this disclosure, there is provided an image forming apparatus including a liquid ejection head. The liquid ejection head includes a plurality of nozzles, a channel member, a common liquid chamber member, a damper member, a damper chamber formation member, a first adhesive, and a second adhesive. The plurality of nozzles ejects liquid droplets. The channel member includes a plurality of individual liquid chambers communicated with the plurality of nozzles. The common liquid chamber member forms a common liquid chamber to supply liquid to the plurality of individual liquid chambers. The damper member has a deformable area forming a portion of a wall of the common liquid chamber. The damper chamber formation member forms a damper chamber disposed opposing the common liquid chamber via the deformable area of the damper member. The damper member is disposed between the common liquid chamber member and the damper chamber formation member. The first adhesive is disposed between the damper member and the common liquid chamber member to bond the damper member with the common liquid chamber member.

The second adhesive is disposed between the damper member and the damper chamber formation member to bond the damper member with the damper chamber formation member. The deformable area of the damper member has a peripheral portion fringed with the first adhesive and the second adhesive.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
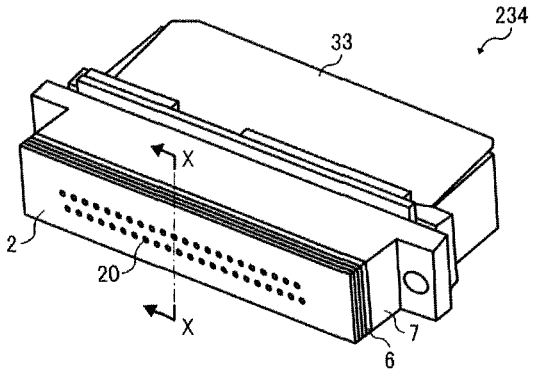
FIG. 1 is an external perspective view of a liquid ejection head according to at least one exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" used herein as synonyms for one another.

The term "image forming apparatus" refers apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution. DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, a liquid ejection head according to at least one exemplary embodiment of this disclosure is described with reference to FIGS. 1 to 5.

Figure 2:
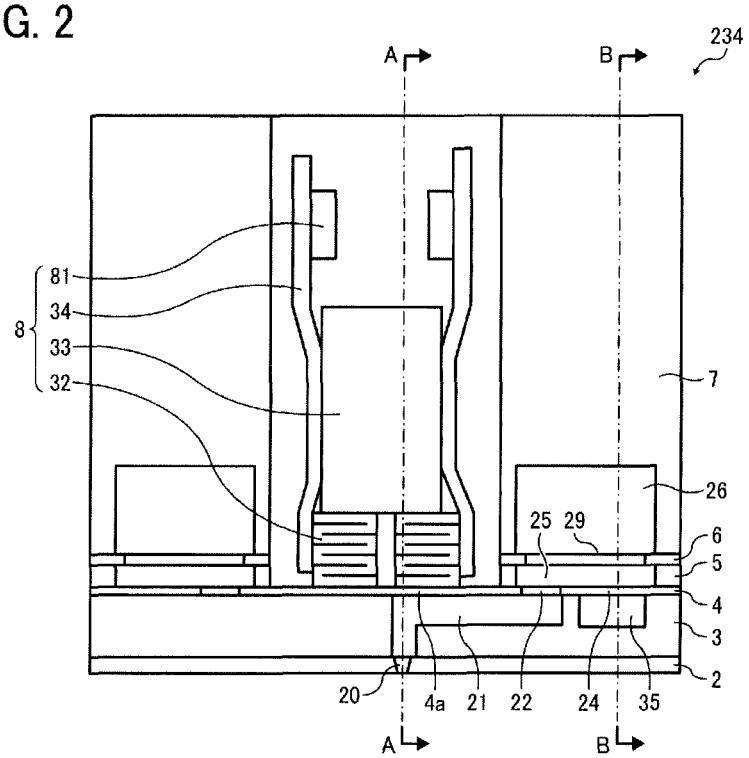
FIG. 2 is a cross-sectional view of the liquid ejection head of FIG. 1 cut along a direction perpendicular to a nozzle array direction parallel to a line X-X of FIG. 1.
Figure 3:
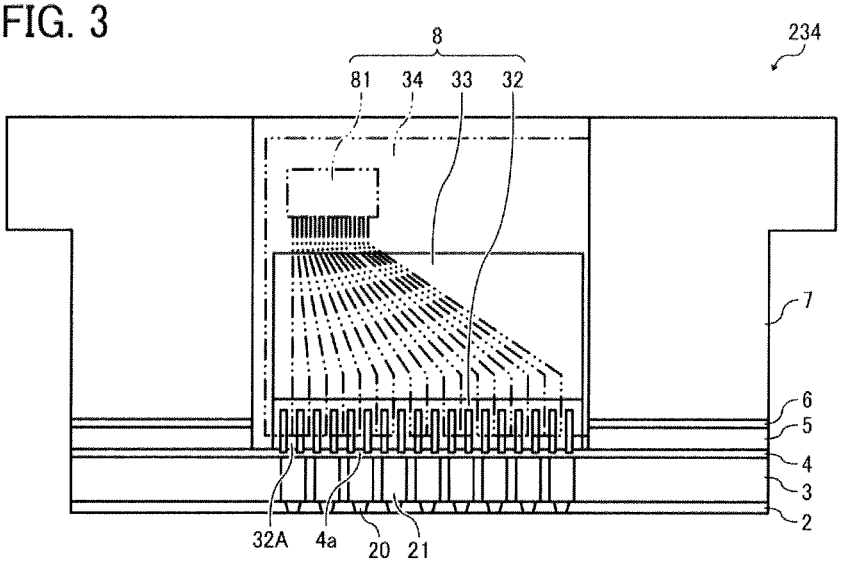
FIG. 3 is a cross-sectional view of the liquid ejection head of FIG. 1 cut along a line A-A of FIG. 2.
Figure 4:
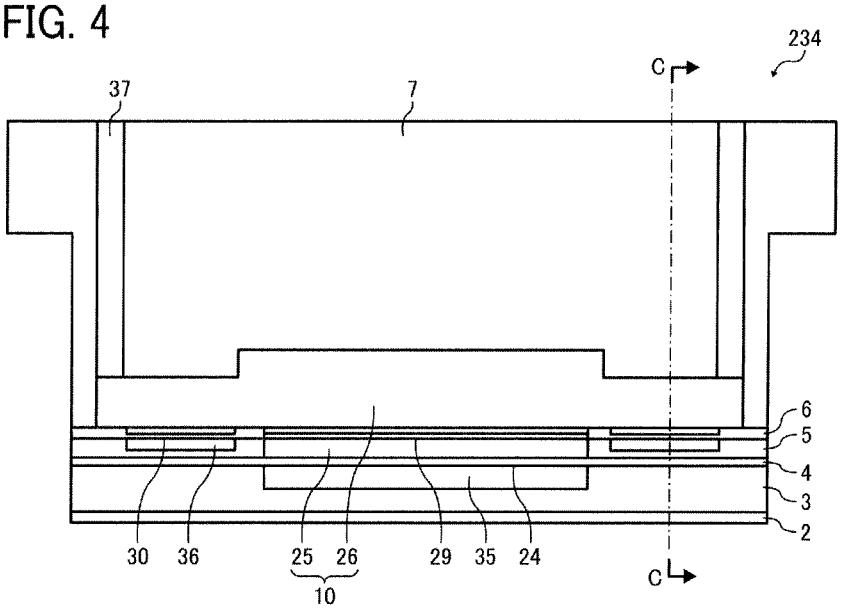
FIG. 4 is a cross-sectional view of the liquid ejection head of FIG. 1 cut along a line B-B of FIG. 2.
Figure 5:
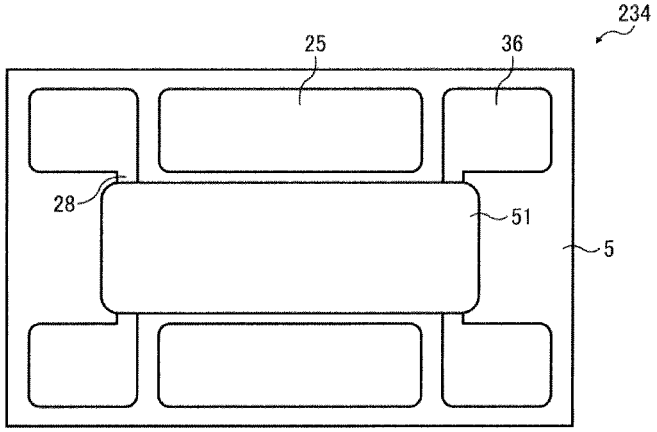
FIG. 5 is a plan view of a second common liquid chamber member of the liquid election head of FIG. 1.

FIG. 1 is an external perspective view of a liquid ejection head 234 according to at least one exemplary embodiment of this disclosure. FIG. 2 is a cross-sectional view of the liquid ejection head 234 cut along a direction perpendicular to a nozzle array direction parallel to a line X-X of FIG. 1. FIG. 3 is a cross-sectional view of the liquid ejection head 234 cut along a line A-A of FIG. 2. FIG. 4 is a cross-sectional view of the liquid ejection head 234 cut along a line B-B of FIG. 2. FIG. 5 is a plan view of a second common liquid chamber member of the liquid ejection head 234.

The liquid ejection head 234 is formed by bonding a nozzle plate 2, a channel plate 3 serving as a channel member, and a diaphragm member 4.

Multiple nozzles 20 to eject liquid droplets are arranged in two rows in a staggered manner in the nozzle plate 2. The nozzles 20 of the nozzle plate 2 are formed by pressing, for example, stainless steel (e.g. SUS-316).

The channel plate 3 includes pressure chambers 21 serving as individual liquid chambers. The pressure chambers 21 are communicated with and serially provided with the nozzles 20. The channel plate 3 is formed and deformed by pressing, for example, stainless steel (e.g., SUS-304) into a plate, and post-processed by grinding both faces of the plate to remove burrs to flatten each face.

The diaphragm member 4 includes a deformable vibration area 4*a* as a portion of a wall face of each of the pressure chambers 21. The diaphragm member 4 also includes liquid supply passages 22, each of which is connected to an under-filter common liquid chamber 25, to communicate the under-filter common liquid chamber 25 with each pressure chamber 21. The diaphragm member 4 is formed by, e.g., nickel electroforming.

At a side of the diaphragm member 4 opposite a side thereof proximal to the pressure chambers 21, a second common liquid chamber member 5 also serving as a damper-chamber formation member, a filter damper member 6 serving as a damper member, and a first common chamber member 7 serving as both a common liquid chamber member and a frame of the liquid ejection head 234 are serially laminated and bonded by adhesives.

The first common chamber member 7 and the second common liquid chamber member 5 form a common chamber 10 communicated with each pressure chamber 21. The common chamber 10 includes an over-filter common chamber 26 disposed upstream from the filter damper member 6 and the under-filter common liquid chamber 25 disposed downstream from the filter damper member 6 in a liquid supply direction in which liquid is supplied from each ink supply port 37 to each nozzle 20.

The filter damper member 6 has a filter area 29 with multiple filter holes and collects foreign substance from liquid flowing from the over-filter common chamber 26 to the under-filter common liquid chamber 25.

At each end portion of the filter damper member 6 in the nozzle array direction is formed a deformable area (hereinafter, damper area) 30 forming a portion of a wall face of the over-filter common chamber 26.

The second common liquid chamber member 5 includes a damper chamber 36 opposing the over-filter common chamber 26 via the damper area 30. As illustrated in FIG. 5, the damper chamber 36 is connected to a through hole 51, in which a piezoelectric actuator 8 is disposed, via an air release passage 28 so as to be open to the atmosphere. A portion of a side wall of the damper chamber 36 has a recessed shape to form the air release passage 28.

The first common chamber member 7 includes the over-filter common chamber 26 and liquid supply ports 37 through which liquid is supplied from the outside. The liquid supply ports 37 are disposed at both ends of the over-filter common chamber 26 in a longitudinal direction of the over-filter common chamber 26. The liquid supply ports 37 are also disposed at end portions outside the damper area 30.

In FIG. 4, the filter damper member 6 has a two-layer structure formed by, e.g., nickel electroforming. A first layer of the filter damper member 6 includes the filter area 29 and the damper area 30. A portion (thick portion) including the first layer and a second layer of the filter damper member 6 serves as a support portion of the first layer. The first layer has a thickness of, e.g., 3 μm and the second layer has a thickness of, e.g., 10 μm. The filter area 29 is disposed in substantially the same range as a range of a length and width of the under-filter common liquid chamber 25. As a result, the length of the filter area 29 in the nozzle array direction is longer than a length of the nozzle array (i.e., a distance in which nozzles are arrayed).

The under-filter common liquid chamber 25 of the second common liquid chamber member 5 is formed by full etching, and the damper chamber 36 is formed together with the air release passage by half etching. The depth of half etching is, for example, approximately half (e.g., 0.1 μm) of a plate thickness (e.g., 0.2 μm) of the second common liquid chamber member 5.

The first common chamber member 7 is made of, e.g., SUS-303, and the over-filter common chamber 26 is formed by cutting SUS-303. Alternatively, the first common chamber member 7 may be made of, e.g., a resin material, and the over-filter common chamber 26 may be formed by injection-molding the resin material.

The piezoelectric actuator 8 is disposed at a side of the vibration area 4*a* of the diaphragm member 4 opposite a side thereof at which the pressure chambers 21 are disposed. In the piezoelectric actuator 8, two piezoelectric members 32 are bonded to a base member 33 along the two corresponding nozzle rows. Each piezoelectric member 32 includes pillar-shaped piezoelectric elements (piezoelectric pillars) 32A arranged at, for example, one half of a pitch between nozzles in each nozzle row. The piezoelectric pillars 32A of the piezoelectric members 32 are bonded to the vibration area 4*a* of the diaphragm member 4. A driving integrated circuit (IC) 81 is mounted on a flexible wire member 34, and driving signals are transmitted from the driving IC 81 to the piezoelectric pillars 32A via the flexible wire member 34.

A portion of the diaphragm member 4 that forms a wall face of the under-filter common liquid chamber 25 is a deformable area (damper area) 24, and a damper chamber 35 is disposed opposing the under-filter common liquid chamber 25 via the damper area 24.

For the above-described liquid ejection head 234 illustrated in FIGS. 1 to 5, when the piezoelectric actuator 8 is driven, the vibration area 4*a* of the diaphragm member 4 is deformed. As a result, liquid of the pressure chambers 21 is pressurized, thus ejecting liquid droplets from the nozzles 20.

Next, a liquid ejection head according to at least one exemplary embodiment of this disclosure is described with reference to FIGS. 6 and 7.

Figure 6:
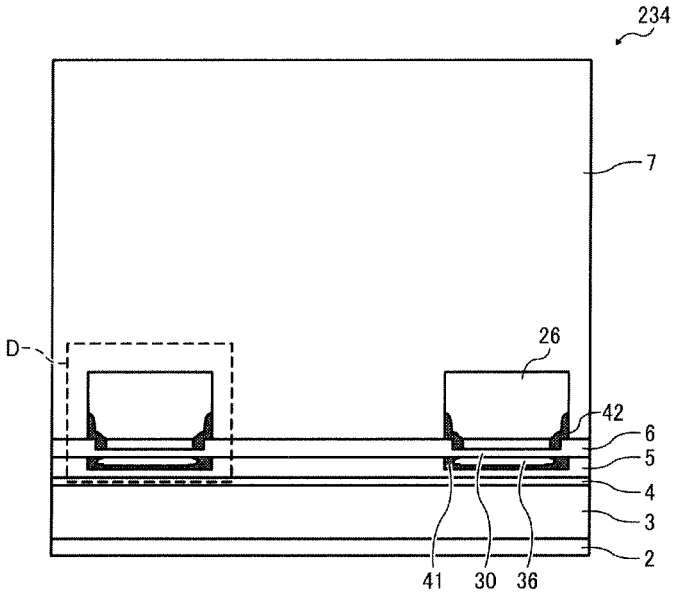
FIG. 6 is a cross-sectional view of a liquid ejection head according to at least one exemplary embodiment of this disclosure, cut along a line C-C of FIG. 4.
Figure 7:
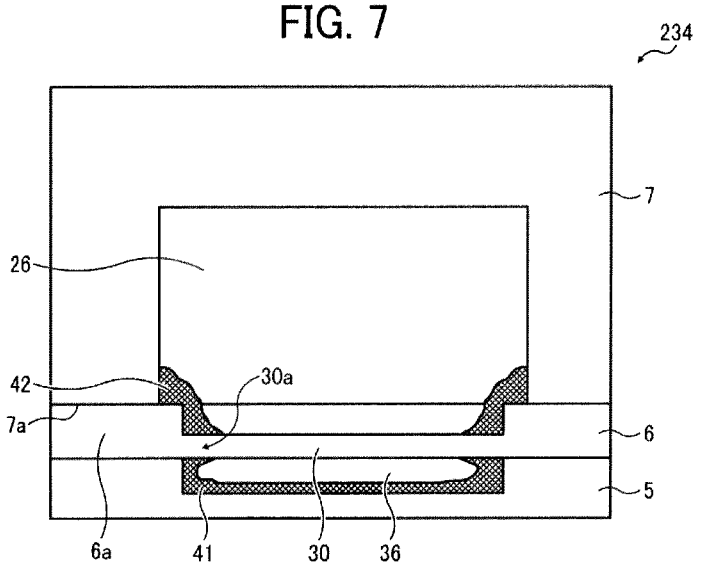
FIG. 7 is an enlarged cross-sectional view of an area D of the liquid ejection head illustrated in FIG. 6.

FIG. 6 is a cross-sectional view of a liquid ejection head 234 according to at least one exemplary embodiment of this disclosure, cut along a line C-C of FIG. 4. FIG. 7 is an enlarged cross-sectional view of an area D of the liquid ejection head 234 illustrated in FIG. 6.

The filter damper member 6 is interposed between the second common liquid chamber member 5 and the first common chamber member 7, and bonded to the second common liquid chamber member 5 and the first common chamber member 7 by adhesives 41 and 42, respectively.

The filter damper member 6 and the second common liquid chamber member 5 are bonded by applying the adhesive 41 to the second common liquid chamber member 5. The adhesive 41 is applied to an entire face of the second common liquid chamber member 5 facing the filter damper member 6 with, e.g., a spray applicator.

By bonding the second common liquid chamber member 5 applied with the adhesive 41 and the filter damper member 6, a surplus of the adhesive 41 flows out from between the second common liquid chamber member 5 and the filter damper member 6 to a peripheral portion 30*a* of the damper area 30 of the filter damper member 6. As a result, the peripheral portion 30*a* of the damper area 30 is fringed with the adhesive 41. The fringe width of the adhesive 41 depends on a bonded width of the second common liquid chamber member 5 and the application amount of the adhesive 41. The fringe width is adjusted so as to be, for example, approximately 10 to 30 μm.

The filter damper member 6 and the first common chamber member 7 are bonded by applying the adhesive 42 to the first common chamber member 7. The adhesive 42 is applied to the first common chamber member 7 by patterning, e.g., a two-part liquid epoxy adhesive.

By bonding the first common chamber member 7 applied with the adhesive 42 and the filter damper member 6, a surplus of the adhesive 42 flows out from between the first common chamber member 7 and the filter damper member 6 to a peripheral portion 30*a* of the damper area 30 of the filter damper member 6. As a result, the peripheral portion 30*a* of the damper area 30 is fringed with the adhesive 42. The fringe width of the adhesive 42 depends on a bonded width of the first common chamber member 7 and the application amount of the adhesive 42. The fringe width is adjusted so as to be, for example, approximately 10 to 30 μm.

For such a configuration, for example, even when the damper area 30 is greatly deformed by pressurizing or sucking operation during initial filling of liquid or maintenance-and-recovery operation, the adhesives 41 and 42 fringing the peripheral portion 30*a* of the damper area 30 can minimize deformation of the damper area 30, thus preventing damage to the damper area 30.

By adjusting the fringing amount of the adhesives according to the deformation amount of the damper (the damper area 30), the above-described configuration is applicable to damper configurations of various sizes. In addition, the above-described configuration can recover a failure (e.g., a pin hole) of the peripheral portion 30*a* by covering the peripheral portion 30*a* with the adhesive. As a result, as compared to a configuration in which a reduced damper area is employed to obtain the same effect, the above-described configuration can achieve relatively high robustness while achieving the same performance.

As described above, in at least one exemplary embodiment of this disclosure, different types (e.g., viscosities) of the adhesives 41 and 42 are used. In addition, the adhesive 41 is, e.g., spray applied to the second common liquid chamber member 5, and the adhesive 42 is applied to the first common chamber member 7 with, e.g., a dispenser. In other words, if a large amount of the adhesive 41 flows out from between the second common liquid chamber member 5 and the filter damper member 6 to a side of the peripheral portion 30*a* of the damper 30 that faces the second common liquid chamber member 5, the adhesive 41 would hamper a liquid flow. Therefore, a thin coat of the adhesive 41 is preferably applied to the second common liquid chamber member 5. Hence, in at least one exemplary embodiment of this disclosure, the adhesive 41 has a viscosity lower than the adhesive 42, thus allowing a thin coat of adhesive 41 to be applied to the second common liquid chamber member 5 by, e.g., spray application.

Next, a liquid ejection head according to at least one exemplary embodiment of this disclosure is described with reference to FIG. 8.

Figure 8:
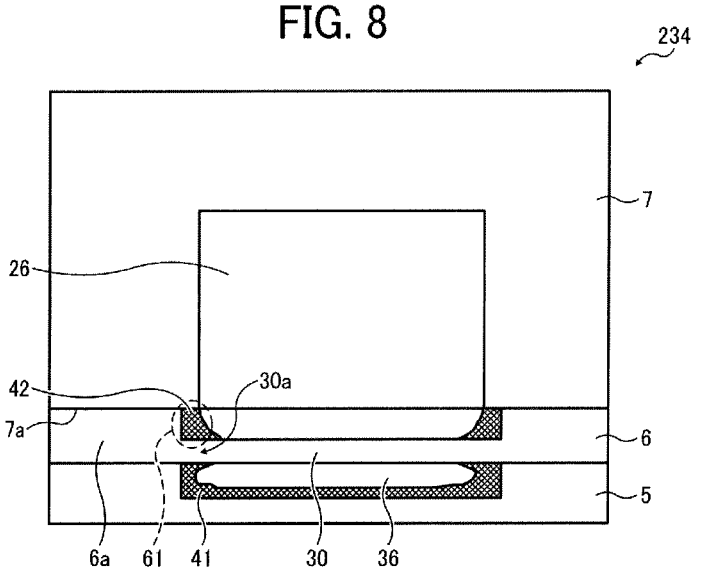
FIG. 8 is an enlarged cross-sectional view of an area corresponding to the area D of FIG. 6 in a liquid ejection head according to at least one exemplary embodiment of this disclosure.

FIG. 8 is an enlarged cross-sectional view of an area corresponding to the area D of FIG. 6 in a liquid ejection head 234 according to at least one exemplary embodiment of this disclosure.

In the liquid ejection head 234 illustrated in FIG. 8, as in the above-described liquid ejection head 234, a filter damper member 6 has a two-layer structure formed by, e.g., nickel electroforming. A first layer of the filter damper member 6 includes a filter area 29 and a damper area 30. A portion (thick portion) 6*a* including the first layer and a second layer of the filter damper member 6 serves as a support portion of the first layer.

As illustrated in FIG. 8, the first common chamber member 7 has an opposing face 7*a* opposing the thick portion 6*a* of the filter damper member 6, and the thick portion 6*a* of the filter damper member 6 is bonded with the opposing face 7*a* of the first common chamber member 7. In this regard, with the opposing face 7*a* of the first common chamber member 7 extending beyond the thick portion 6*a* of the filter damper member 6 to a position opposing the damper area 30, the opposing face 7*a* of the first common chamber member 7 is bonded with the thick portion 6*a* of the filter damper member 6.

As a result, the adhesive 42 of the first common chamber member 7 is incorporated into a recessed portion 61. The recessed portion 61 is formed with the first common chamber member 7, the thick portion 6*a* of the filter damper member 6, and the damper area 30.

By adjusting the recessed portion 61 and the application amount of the adhesive 42, the amount of the adhesive 42 that flows out from between the first common chamber member 7 and the thick portion 6*a* (i.e., outflows into the damper area 30) can be adjusted, thus minimizing variations in the damper performance of the damper area 30.

Next, a liquid ejection head according to at least one exemplary embodiment of this disclosure is described with reference to FIGS. 9 and 10.

Figure 9:
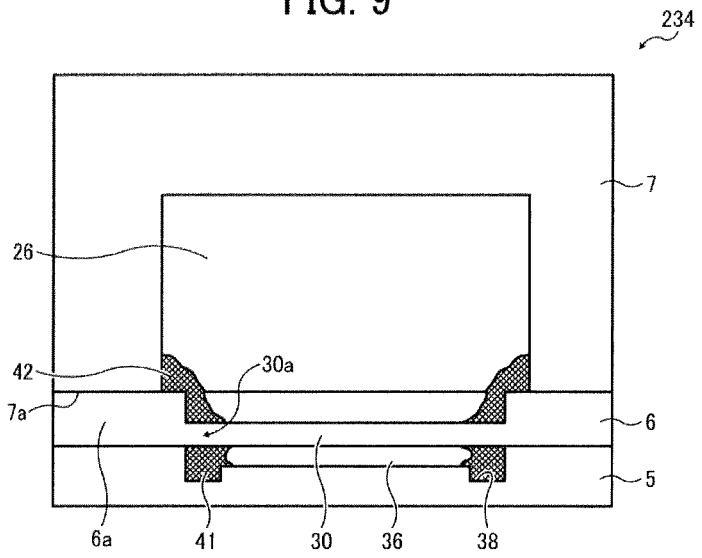
FIG. 9 is an enlarged cross-sectional view of an area corresponding to the area D of FIG. 6 in a liquid ejection head according to at least one exemplary embodiment of this disclosure.

FIG. 9 is an enlarged cross-sectional view of an area corresponding to the area D of FIG. 6 in a liquid ejection head 234 according to at least one exemplary embodiment of this disclosure. FIG. 10 is a plan view of a second common liquid chamber member of the liquid ejection head 234 illustrated in FIG. 9.

Figure 10:
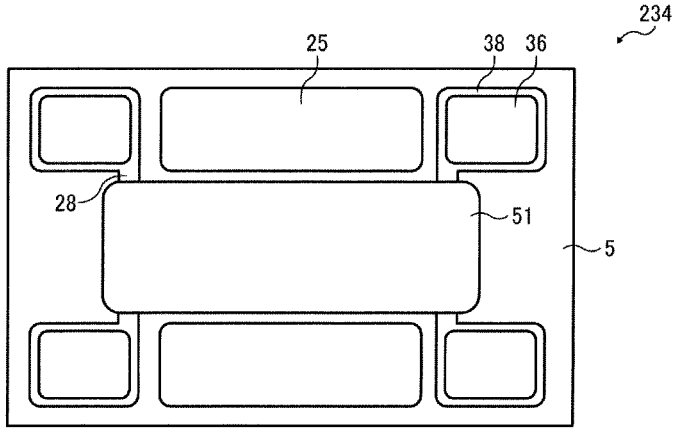
FIG. 10 is a plan view of a second common liquid chamber member of the liquid ejection head illustrated in FIG. 9.

For the liquid ejection head 234 illustrated in FIGS. 9 and 10, a second common liquid chamber member 5 has damper chambers 36 and grooves 38. Each groove 38 is formed in the corresponding damper chamber 36 so as to oppose a peripheral portion 30*a* of a corresponding damper area 30.

Such a configuration allows control of the outflow amount of adhesive 41 that flows out from between the second common liquid chamber member 5 and a filter damper member 6. As a result, even if a relatively large amount of the adhesive 41 is applied due to variations in the application amount, such a configuration can maintain the outflow of the adhesive 41 within a predetermined range and minimize variations in the damper performance of the damper area 30.

For the liquid ejection head 234 illustrated in FIGS. 9 and 10, a first common chamber member 7 has an opposing face 7*a* opposing a thick portion 6*a* of the filter damper member 6, and the opposing face 6*a* of the first common chamber member 7 is bonded with the thick portion 6*a* of the filter damper member 6. However, unlike the liquid ejection head 234 illustrated in FIG. 8, with the opposing face 7*a* of the first common chamber member 7 placed at a position retracted from the damper area 30 (sec FIG. 9), the opposing face 7*a* of the first common chamber member 7 is bonded with the thick portion 6*a* of the filter damper member 6. Alternatively, the bonding configuration of the first common chamber member 7 and the filter damper member 6 may be the same as that of the liquid ejection head 234 illustrated in FIG. 7 or 8.

Alternatively, the above-described liquid ejection head may be integrated with a liquid tank for supplying liquid to the liquid ejection head to form a head-integrated liquid cartridge (cartridge-integrated head).

Thus, the liquid ejection head according to at least one exemplary embodiment of this disclosure can stably eject liquid droplets while maintaining effective vibration absorbing performance and preventing the damper (damper area) from being damaged.

Next, an image forming apparatus according to at least one exemplary embodiment of this disclosure is described with reference to FIGS. 11 and 12.

Figure 11:
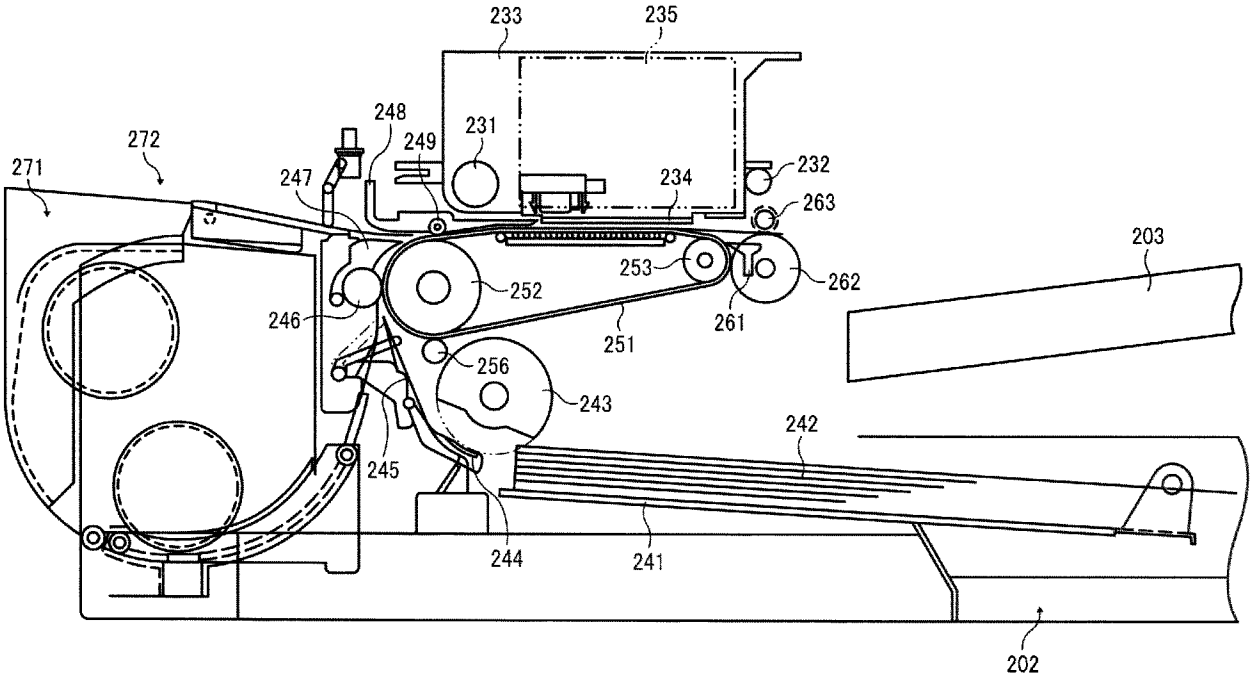
FIG. 11 is a side view of a mechanical section of an image forming apparatus according to at least one exemplary embodiment of this disclosure.

FIG. 11 is a side view of a mechanical section of an image forming apparatus according to at least one exemplary embodiment of this disclosure. FIG. 12 is a partial plan view of the mechanical section of FIG. 11.

Figure 12:
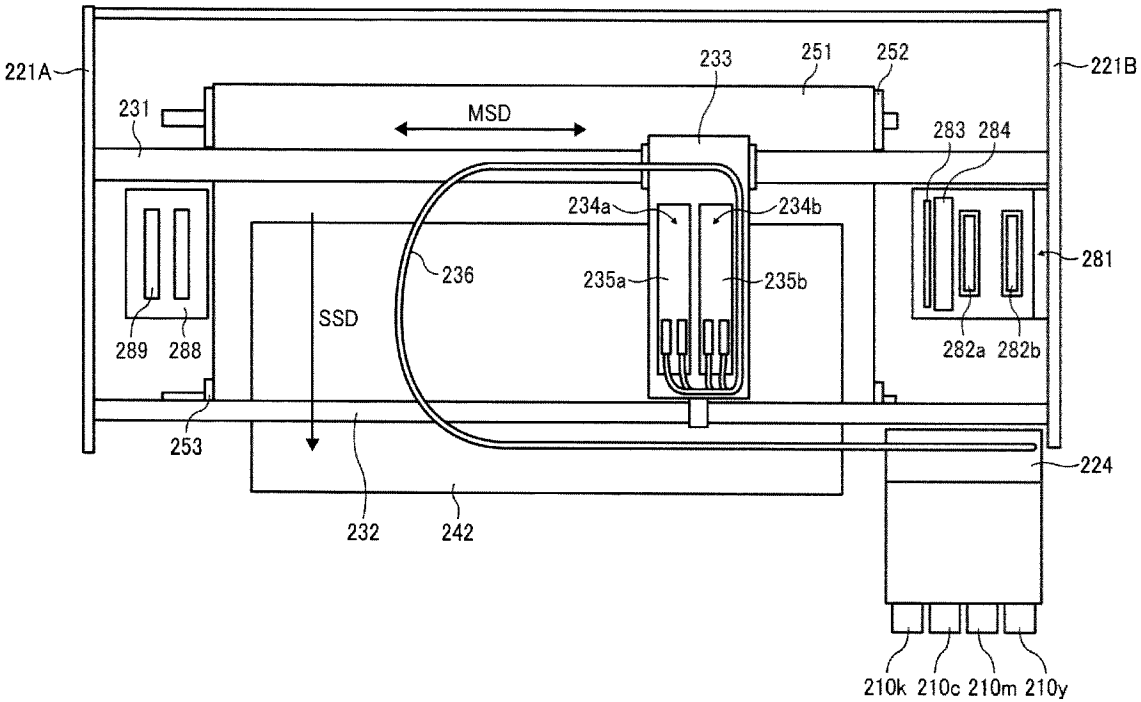
FIG. 12 is a partial plan view of the mechanical section illustrated in FIG. 11.

The image forming apparatus illustrated in FIGS. 11 and 12 is a serial-type image forming apparatus. In the image forming apparatus, a carriage 233 is supported by a main guide rod 231 and a sub guide rod 232 so as to be slidable in a direction (main scanning direction) indicated by an arrow MSD in FIG. 12. The main guide rod 231 and the sub guide rod 232 serving as guide members extend between a left side plate 221A and a right side plate 221B. The carriage 233 is reciprocally moved for scanning in the main scanning direction MSD by a main scanning motor via a timing belt.

The carriage 233 mounts liquid ejection heads 234*a* and 234*b* (collectively referred to as "liquid ejection heads 234" unless distinguished) serving as recording heads for ejecting ink droplets of different colors, e.g., yellow (Y), cyan (C), magenta (M), and black (K). The liquid ejection heads 234*a* and 2346 are mounted on the carriage 233 so that nozzle rows, each of which includes multiple nozzles, are arranged in parallel to a direction (sub scanning direction indicated by an arrow SSD in FIG. 12) perpendicular to the main scanning direction MSD and ink droplets are ejected downward from the nozzles.

Each of the liquid ejection heads 234*a* and 234*b* serving as the recording heads has two nozzle rows and is mounted on a base member. For example, one of the nozzles rows of the liquid ejection head 234*a* may eject liquid droplets of black (K) and the other ejects liquid droplets of cyan (C). In addition, one of the nozzles rows of the liquid ejection head 234*b* may eject liquid droplets of magenta (M) and the other ejects liquid droplets of yellow (Y). It is to be noted that the image forming apparatus illustrated in FIGS. 11 and 12 ejects four color liquids in the above-described two-head configuration. Alternatively, an image forming apparatus according to another exemplary embodiment may have liquid ejection heads corresponding to respective colors.

The carriage 233 mounts head tanks 235*a* and 235*h* (collectively referred to as "head tanks 235" unless distinguished) to supply the respective color inks to the corresponding nozzle rows of the liquid ejection heads 234. A supply unit 224 replenishes and supplies respective color inks from ink cartridges 210 to the sub tanks 235 via supply tubes 236.

The image forming apparatus further includes a sheet feed section to feed sheets 242 stacked on a sheet stack portion (platen) 241 of a sheet feed tray 202. The sheet feed section further includes a sheet feed roller 243 and a separation pad 244. The sheet feed roller 243 has a shape of, e.g., a substantially half moon to separate the sheets 242 from the sheet stack portion 241 and feed the sheets 242 sheet by sheet. The separation pad 244 made of a material of a high friction coefficient relative to the sheets 242 is disposed opposing the sheet feed roller 243 and urged toward the sheet feed roller 243.

To feed the sheet 242 from the sheet feed section to a position below the liquid ejection heads 234, the image forming apparatus illustrated in FIGS. 11 and 12 includes a first guide member 245 to guide the sheet 242, a counter roller 246, a conveyance guide member 247, a pressing member 248 including a front-end pressing roller 249, and a conveyance belt 251 to adhere the sheet 242 thereon by static electricity and convey the sheet 242 to a position opposing the liquid ejection heads 234.

The conveyance belt 251 is an endless belt that is looped between a conveyance roller 252 and a tension roller 253 so as to circulate in a belt conveyance direction (sub-scanning direction indicated by the arrow SSD in FIG. 12). The image forming apparatus also has a charging roller 256 serving as a charging device to charge the surface of the conveyance belt 251. The charging roller 256 is disposed so as to contact an outer surface of the conveyance belt 251 and rotate with the circulation of the conveyance belt 251. The conveyance roller 251 is rotated by a sub scanning motor via a timing belt, so that the conveyance belt 251 circulates in the belt conveyance direction.

The image forming apparatus further includes a sheet output section to output the sheet 242 on which an image has been formed by the liquid ejection heads 234. The sheet output section includes a separation claw 261 to separate the sheet 242 from the conveyance belt 251, a first output roller 262, a spur 263 serving as a second output roller, and a sheet output tray 203 disposed at a position lower than the first output roller 262.

A duplex unit 271 is detachably mounted on a rear face portion of the apparatus body. When the conveyance belt 251 rotates in reverse to return the sheet 242, the duplex unit 271 receives the sheet 242. The duplex unit 271 reverses and feeds the sheet 242 to a nipping portion between the counter roller 246 and the conveyance belt 251. A bypass tray 272 is formed at an upper face of the duplex unit 271.

As illustrated in FIG. 12, a maintenance device (maintenance and recovery device) 281 is disposed in a non-printing area (non-recording area) at one end in the main scanning direction MSD of the carriage 233. The maintenance device 281 maintains and recovers nozzle conditions of the liquid ejection heads 234. The maintenance device 281 includes caps 282*a* and 282*b*, a wiping member 283, and a first dummy-ejection receptacle 284. The caps 282*a* and 282*b* (hereinafter, collectively referred to as "caps 282" unless distinguished) cap nozzle faces of the liquid ejection heads 234. The wiping member (wiper blade) 283 serves as a blade member to wipe the nozzle faces of the liquid ejection heads 234. The first dummy-ejection receptacle 284 receives liquid droplets ejected by dummy ejection in which liquid droplets not contributing to image recording are ejected to remove viscosity-increased recording liquid.

As illustrated in FIG. 12, a second dummy ejection receptacle 288 is disposed at a non-printing area on the opposite end in the main scanning direction MSD of the carriage 233. The second dummy ejection receptacle 288 receives liquid droplets ejected, e.g., during recording (image forming) operation by dummy ejection in which liquid droplets not contributing to image recording are ejected to remove viscosity-increased recording liquid. The second dummy ejection receptacle 288 has openings 289 arranged in parallel to the nozzle rows of the liquid ejection heads 234.

In the image forming apparatus having the above-described configuration, the sheet 242 is separated sheet by sheet from the sheet feed tray 202, fed in a substantially vertically upward direction, guided along the first guide member 245, and conveyed while being sandwiched between the conveyance belt 251 and the counter roller 246. Further, the front end of the sheet 242 is guided by a conveyance guide member 237 and is pressed against the conveyance belt 251 by the front-end pressing roller 249 to turn the transport direction of the sheet 242 by approximately 90°.

At this time, positive and negative voltages are alternately supplied to the charging roller 256 so that plus outputs and minus outputs to the charging roller 256 are alternately repeated. As a result, the conveyance belt 251 is charged in an alternating voltage pattern, that is, so that positively charged areas and negatively charged areas are alternately repeated at a certain width in the sub-scanning direction SSD, i.e., the belt conveyance direction. When the sheet 242 is fed onto the conveyance belt 251 alternately charged with positive and negative charges, the sheet 242 is adhered on the conveyance belt 251 and conveyed in the sub scanning direction by the circulation of the conveyance belt 251.

By driving the liquid ejection heads 234 in accordance with image signals while moving the carriage 233, ink droplets are ejected onto the sheet 242, which is stopped below the liquid ejection heads 234, to form one line of a desired image. Then, after the sheet 242 is fed by a certain distance, the liquid ejection heads 234 record another line of the image. Receiving a recording end signal or a signal indicating that the rear end of the sheet 242 has arrived at the recording area, the recording operation finishes and the sheet 242 is output to the sheet output tray 203.

As described above, the image forming apparatus has liquid ejection heads according to at least one exemplary embodiment of this disclosure and can stably eject liquid droplets from the liquid ejection heads while maintaining effective vibration absorbing performance of the liquid ejection heads and preventing a damper (damper area) of each liquid ejection head from being damaged.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid ejection head, comprising:

a plurality of nozzles to eject liquid droplets;

a channel member including a plurality of individual liquid chambers communicated with the plurality of nozzles;

a common liquid chamber member forming a common liquid chamber to supply liquid to the plurality of individual liquid chambers;

a damper member having a deformable area forming a portion of a wall of the common liquid chamber;

a damper chamber formation member forming a damper chamber disposed opposing the common liquid chamber via the deformable area of the damper member, the damper member being disposed between the common liquid chamber member and the damper chamber formation member;

a first adhesive disposed between the damper member and the common liquid chamber member to bond the damper member with the common liquid chamber member;

a second adhesive disposed between the damper member and the damper chamber formation member to bond the damper member with the damper chamber formation member; and a filter member disposed in the common liquid chamber to filter a foreign substance from the liquid, wherein the deformable area of the damper member has a peripheral portion fringed with the first adhesive and the second adhesive, the filter member is an integral part of the damper member, the common liquid chamber member includes a first common liquid chamber member and a second common liquid chamber member, the first common liquid chamber member includes a first common liquid chamber of the common liquid chamber disposed upstream from the filter member in a direction in which the liquid is supplied to the plurality of individual liquid chambers, the second common liquid chamber member includes a second common liquid chamber of the common liquid chamber disposed downstream from the filter member in the direction in which the liquid is supplied to the plurality of individual liquid chambers, and the second common liquid chamber member is an integral part of the damper chamber formation member.

2. The liquid ejection head of claim 1, wherein the damper member has a thick portion outside the peripheral portion of the deformable area, the thick portion being thicker than the deformable area, the common liquid chamber member has an opposing face opposing the thick portion of the damper member, and the thick portion of the damper member and the common liquid chamber member are bonded with the opposing face of the common liquid chamber member extending beyond the thick portion of the damper member to a position opposing the deformable area.

3. The liquid ejection head of claim 1, wherein the damper chamber has a groove opposing the peripheral portion of the deformable area and the second adhesive is disposed in the groove.

4. The liquid ejection head of claim 1, wherein the first adhesive and the second adhesive are different types of adhesives.

5. An image forming apparatus comprising a liquid ejection head, the liquid ejection head comprising a plurality of nozzles to eject liquid droplets, a channel member including a plurality of individual liquid chambers communicated with the plurality of nozzles, a common liquid chamber member forming a common liquid chamber to supply liquid to the plurality of individual liquid chambers, a damper member having a deformable area forming a portion of a wall of the common liquid chamber, a damper chamber formation member forming a damper chamber disposed opposing the common liquid chamber via the deformable area of the damper member, the damper member being disposed between the common liquid chamber member and the damper chamber formation member, a first adhesive disposed between the damper member and the common liquid chamber member to bond the damper member with the common liquid chamber member, and a second adhesive disposed between the damper member and the damper chamber formation member to bond the damper member with the damper chamber formation member; and a filter member disposed in the common liquid chamber to filter a foreign substance from the liquid, wherein the deformable area of the damper member has a peripheral portion fringed with the first adhesive and the second adhesive, the filter member is an integral part of the damper member, the common liquid chamber member includes a first common liquid chamber member and a second common liquid chamber member, the first common liquid chamber member includes a first common liquid chamber of the common liquid chamber disposed upstream from the filter member in a direction in which the liquid is supplied to the plurality of individual liquid chambers, the second common liquid chamber member includes a second common liquid chamber of the common liquid chamber disposed downstream from the filter member in the direction in which the liquid is supplied to the plurality of individual liquid chambers, and the second common liquid chamber member is an integral part of the damper chamber formation member.

6. The image forming apparatus of claim 5, wherein the damper chamber has a groove opposing the peripheral portion of the deformable area and the second adhesive is disposed in the groove.

7. The image forming apparatus of claim 5, wherein the first adhesive and the second adhesive are different types of adhesives.

8. The image forming apparatus of claim 5, wherein the damper member has a thick portion outside the peripheral portion of the deformable area, the thick portion being thicker than the deformable area, the common liquid chamber member has an opposing face opposing the thick portion of the damper member, and the thick portion of the damper member and the common liquid chamber member are bonded with the opposing face of the common liquid chamber member extending beyond the thick portion of the damper member to a position opposing the deformable area.

9. An image forming apparatus comprising a liquid ejection head, the liquid ejection head comprising:

a plurality of nozzles to eject liquid droplets;

a channel member including a plurality of individual liquid chambers communicated with the plurality of nozzles;

a common liquid chamber member forming a common liquid chamber to supply liquid to the plurality of individual liquid chambers;

a damper member having a deformable area forming a portion of a wall of the common liquid chamber;

a damper chamber formation member forming a damper chamber disposed opposing the common liquid chamber via the deformable area of the damper member, the damper member being disposed between the common liquid chamber member and the damper chamber formation member;

a first adhesive disposed between the damper member and the common liquid chamber member to bond the damper member with the common liquid chamber member; and a second adhesive disposed between the damper member and the damper chamber formation member to bond the damper member with the damper chamber formation member, wherein the deformable area of the damper member has a peripheral portion fringed with the first adhesive and the second adhesive, the damper member has a thick portion outside the peripheral portion of the deformable area, the thick portion being thicker than the deformable area, the common liquid chamber member has an opposing face opposing the thick portion of the damper member, and the thick portion of the damper member and the common liquid chamber member are bonded with the opposing face of the common liquid chamber member extending beyond the thick portion of the damper member to a position opposing the deformable area.

* * * * *